US011239019B2

(12) United States Patent
Endo et al.

(10) Patent No.: US 11,239,019 B2
(45) Date of Patent: Feb. 1, 2022

(54) COIL COMPONENT AND METHOD OF MANUFACTURING COIL COMPONENT

(71) Applicant: TDK CORPORATION, Tokyo (JP)

(72) Inventors: Makoto Endo, Tokyo (JP); Mitsunori Hiraoka, Tokyo (JP); Kazuhiko Ito, Tokyo (JP)

(73) Assignee: TDK CORPORATION, Tokyo (JP)

( * ) Notice: Subject to any disclaimer, the term of this patent is extended or adjusted under 35 U.S.C. 154(b) by 736 days.

(21) Appl. No.: 15/934,103

(22) Filed: Mar. 23, 2018

(65) Prior Publication Data

US 2018/0277296 A1 Sep. 27, 2018

(30) Foreign Application Priority Data

Mar. 23, 2017 (JP) ..... JP2017-058020
Mar. 23, 2017 (JP) ..... JP2017-058022

(51) Int. Cl.

| | |
|---|---|
| ***H01F 5/00*** | (2006.01) |
| ***H01F 27/255*** | (2006.01) |
| ***H01F 27/28*** | (2006.01) |
| ***H01F 27/29*** | (2006.01) |
| ***H01F 41/04*** | (2006.01) |

(52) U.S. Cl.
CPC ..... *H01F 27/255* (2013.01); *H01F 5/003* (2013.01); *H01F 27/2804* (2013.01); *H01F 27/292* (2013.01); *H01F 41/046* (2013.01)

(58) Field of Classification Search
CPC ..... H01F 27/2804
USPC ..... 336/200
See application file for complete search history.

(56) References Cited

U.S. PATENT DOCUMENTS

| | | | |
|---|---|---|---|
| 5,250,923 | A | 10/1993 | Ushiro et al. |
| 5,552,756 | A | 9/1996 | Ushiro |
| 5,850,682 | A | 12/1998 | Ushiro |
| 6,448,879 | B1 | 9/2002 | Kitamura |
| 6,515,568 | B1 | 2/2003 | Maki et al. |
| 6,593,841 | B1 | 7/2003 | Mizoguchi et al. |
| 7,091,816 | B1 | 8/2006 | Ito et al. |
| 2002/0093415 | A1 | 7/2002 | Kitamura |
| 2003/0076211 | A1 | 4/2003 | Matsuta et al. |

(Continued)

FOREIGN PATENT DOCUMENTS

| | | | |
|---|---|---|---|
| JP | 2003-133135 | A | 5/2003 |
| JP | 2013-211302 | A | 10/2013 |

(Continued)

*Primary Examiner* — Ronald Hinson
(74) *Attorney, Agent, or Firm* — Oliff PLC

(57) ABSTRACT

There is provided a coil component including a coil portion that has at least one layer of planar coil including a coil-wound portion and an insulative layer which covers the periphery of the coil-wound portion, a covering portion that covers the coil portion and is constituted of a mixture including magnetic fillers and resin, and a conductor post that is penetratingly provided inside the covering portion and extends from the coil-wound portion to an upper surface of the covering portion along an axial direction of the planar coil. The conductor post has a post portion which extends from the coil-wound portion in the axial direction of the planar coil, and a lid portion which is exposed from the covering portion and extends from an end portion of the post portion on the upper surface side along a surface direction of the upper surface.

11 Claims, 15 Drawing Sheets

(56) References Cited

U.S. PATENT DOCUMENTS

2004/0061587 A1 4/2004 Hong et al.
2004/0070480 A1 4/2004 Nakashima et al.
2005/0050717 A1 3/2005 Yoshida et al.
2005/0068148 A1 3/2005 Yoshida et al.
2005/0116793 A1 6/2005 Shoji
2005/0181684 A1 8/2005 Ito et al.
2005/0184848 A1 8/2005 Yoshida et al.
2005/0195062 A1 9/2005 Yoshida et al.
2005/0246001 A1 11/2005 Kast et al.
2006/0068330 A1 3/2006 Kamijima
2006/0068602 A1 3/2006 Kamijima
2006/0097835 A1 5/2006 Tomonari et al.
2006/0176138 A1 8/2006 Ito et al.
2006/0290460 A1 12/2006 Waffenschmidt et al.
2007/0033798 A1 2/2007 Yoshida et al.
2007/0057755 A1 3/2007 Suzuki et al.
2007/0182519 A1 8/2007 Tsuzuki et al.
2007/0285202 A1 12/2007 Ito et al.
2008/0061917 A1 3/2008 Manoukian et al.
2008/0100409 A1 5/2008 Nishikawa et al.
2008/0129439 A1 6/2008 Nishikawa et al.
2008/0290977 A1 11/2008 Ito et al.
2009/0003191 A1 1/2009 Inuzuka et al.
2009/0243777 A1 10/2009 Toi et al.
2009/0256668 A1 10/2009 Noma et al.
2009/0284340 A1 11/2009 Nishikawa et al.
2010/0259351 A1 10/2010 Bogert et al.
2011/0037542 A1 2/2011 Page et al.
2011/0267166 A1 11/2011 Matsushita et al.
2012/0013423 A1 1/2012 Page et al.
2012/0019343 A1 1/2012 Hsieh et al.
2012/0131792 A1 5/2012 Tseng
2012/0161909 A1 6/2012 Wilson et al.
2013/0082807 A1 4/2013 Wilson et al.
2013/0113593 A1 5/2013 Jeong et al.
2013/0162371 A1 6/2013 Lee et al.
2013/0229253 A1 9/2013 Inui et al.
2013/0249662 A1* 9/2013 Tonoyama ..... H01F 17/0013 336/200
2013/0257576 A1 10/2013 Arata et al.
2013/0314194 A1 11/2013 Sato
2014/0009254 A1 1/2014 Ohkubo et al.
2014/0062637 A1* 3/2014 Yoo ..... H01F 27/40 336/105
2014/0191824 A1 7/2014 Yoshino et al.
2014/0240075 A1 8/2014 Yang et al.
2014/0285307 A1 9/2014 Ishida et al.
2014/0292466 A1 10/2014 Watanabe et al.
2015/0097648 A1 4/2015 Kido et al.
2015/0116973 A1 4/2015 Chen et al.
2015/0214915 A1 7/2015 Yosui et al.
2015/0357115 A1 12/2015 Ohkubo et al.
2016/0094082 A1 3/2016 Ookawa et al.
2016/0126004 A1 5/2016 Yang et al.
2016/0142031 A1 5/2016 Ueki et al.
2017/0200554 A1* 7/2017 Kudo ..... H01F 27/255

FOREIGN PATENT DOCUMENTS

JP 2014-170917 A 9/2014
JP 2014-197590 A 10/2014

* cited by examiner

COIL COMPONENT AND METHOD OF MANUFACTURING COIL COMPONENT

CROSS-REFERENCE TO RELATED APPLICATIONS

This application is based upon and claims the benefit of priority from Japanese Patent Applications No. 2017-058020 and No. 2017-058022, filed on 23 Mar. 2017, the entire contents of which are incorporated herein by reference.

BACKGROUND OF THE INVENTION

Field of the Invention

This disclosure relates to a coil component and a method of manufacturing a coil component.

Related Background Art

As a coil component in the related art the, Japanese Unexamined Patent Publication No. 2003-133135 (Patent Literature 1) discloses a coil component including a first magnetic substrate, a coil portion that is installed on the first magnetic substrate in a state where a coil is electrically insulated by an insulative layer, a magnetic layer that covers an upper surface of the coil portion, and a terminal electrode that is conducted to an electrode lead-out portion of the coil.

Incidentally, as a material constituting the magnetic layer disclosed in Patent Literature 1, there are cases of using a magnetic resin in which magnetic fillers and resin are mixed. However, due to internal stress of a coil component, external force, and the like, the magnetic filler may fall off from the magnetic layer. Particularly, since the magnetic layer and the electrode lead-out portion are constituted of materials different from each other, adhesion between the magnetic layer and the electrode lead-out portion is low. Thus, the magnetic filler is likely to fall off in the vicinity of an interface between the magnetic layer and the electrode lead-out portion.

This disclosure provides a coil component, in which the magnetic filler is able to be prevented from falling off, and a method of manufacturing a coil component.

According to an aspect of this disclosure, there is provided a coil component including a coil portion having at least one layer of planar coil including a coil-wound portion and an insulative layer covering the periphery of the coil-wound portion, a covering portion covering the coil portion and constituted of a mixture including magnetic fillers and resin, and a conductor post provided inside the covering portion so as to penetrate the covering portion and extending from the coil-wound portion to an outer surface of the covering portion along an axial direction of the planar coil. The conductor post has a post portion and a lid portion. the post portion extends from the coil-wound portion in the axial direction of the planar coil. The lid portion is exposed from the covering portion and extends from an end portion of the post portion on the outer surface side along a surface direction of the outer surface.

In the coil component, the covering portion around the post portion of the conductor post is covered with the lid portion of the conductor post. In the covering portion covered with the lid portion of the conductor post, the magnetic filler can be prevented from falling off from the covering portion.

According to the aspect, dimensions of the lid portion in the surface direction of the outer surface may be ten times or greater than an average particle diameter of the magnetic filler. Since the lid portion is increased in size ten times or greater than the magnetic filler, the magnetic filler can be more effectively prevented from falling off from the covering portion.

According to the aspect, dimensions of the lid portion in the surface direction of the outer surface may be 1.1 times or greater than dimensions of the post portion. In this case, since an area of the covering portion covered with the lid portion can be increased, the magnetic filler can be more effectively prevented from falling off from the covering portion.

According to the aspect, a ratio of the magnetic filler included in the covering portion may be 80 weight % or higher. In order to increase saturation magnetic flux density of the covering portion, the ratio of the magnetic filler included in the covering portion can be high. However, if the ratio of the magnetic filler increases, the amount of the resin which functions as a binder connecting the magnetic fillers with each other is reduced. Accordingly, the magnetic filler is likely to fall off. In contrast, according to the coil component described above, since the covering portion around the conductor post is covered with the lid portion, even if the ratio of the magnetic filler is 80 weight % or higher at which the magnetic filler is likely to fall off, saturation magnetic flux density of the covering portion can be improved and the magnetic filler can be prevented from falling off.

According to the aspect, the coil component further includes a cover insulative layer stacked on the covering portion and having an opening at a position corresponding to the conductor post exposed from the covering portion, and an external terminal stacked on the cover insulative layer and connected electrically to the conductor post via the opening of the cover insulative layer. Both a forming region in of the external terminal and a forming region of the lid portion are entirely overlapping a forming region of the opening, and an area of the forming region of the external terminal and an area of the forming region of the lid portion are wider than an area of the forming region of the opening.

The conductor post of the coil component has the post portion extending in the axial direction, and the lid portion extending from the end portion of the post portion on the outer surface side along the outer surface. In a plane along the outer surface, the area of the post portion is smaller than the area of the lid portion. In this manner, since the lid portion having a relatively significant area is provided in a part in which the conductor post and the external terminal are connected to each other, and the area of the post portion is caused to be relatively small, a contact area between the conductor post and the external terminal can be ensured, and the covering portion can be prevented from being reduced in volume. Therefore, reliability of electrical connection of the coil component can be retained, and deterioration of saturation magnetic flux density can be prevented. In addition, in a plane along the outer surface, the area of the external terminal and the area of the lid portion are wider than the area of the opening. Since the lid portion is provided in this manner, a connection area between the external terminal and the conductor post is regulated by the area of the opening in the cover insulative layer. Therefore, it is possible to prepare a connection structure between the conductor post and the external terminal having dimensions as designed.

According to the aspect, a cross-sectional area of the post portion in a cross section on a plane orthogonal to the axial direction of the planar coil may be smaller than the area of the opening. In this case, since the volume of the post portion can be reduced, the volume of the covering portion can be further prevented from being reduced. Therefore, deterioration of saturation magnetic flux density of the coil component can be further prevented. In addition, since the lid portion is provided, even in a case where the area of the post portion is smaller than the area of the opening in the cover insulative layer, the connection area between the conductor post and the external terminal can be prevented from being reduced.

According to the aspect, the entirely of the forming region of the lid portion may be covered with the external terminal when seen in the axial direction of the planar coil. In this case, since the volume of the lid portion can be reduced, the volume of the covering portion can be further prevented from being reduced. Therefore, deterioration of saturation magnetic flux density of the coil component can be further prevented.

According to the aspect, a thickness of the lid portion may be smaller than a thickness of the external terminal. In this case, since the volume of the lid portion can be reduced, the volume of the covering portion can be further prevented from being reduced. Therefore, deterioration of saturation magnetic flux density of the coil component can be further prevented.

According to another aspect of the present disclosure, there is provided a method of manufacturing a coil component including a first step of forming a coil portion having at least one layer of planar coil including a coil-wound portion and an insulative layer covering the periphery of the coil-wound portion, a second step of forming a covering portion covering the coil portion with a material including magnetic fillers and resin, and a third step of forming a conductor post extending from the coil-wound portion to an outer surface of the covering portion along an axial direction of the planar coil. In the third step, the conductor post having a post portion and a lid portion is formed. The conductor post extends from the coil-wound portion along the axial direction of the planar coil. The lid portion is exposed from the covering portion and extends from an end portion of the post portion on the outer surface side along a surface direction of the outer surface.

In the method of manufacturing a coil component, in the third step, the lid portion extending from the end portion of the post portion on the outer surface side along the outer surface is formed. Accordingly, in surroundings of the post portion, the covering portion is in a state of being covered with the lid portion. Therefore, the magnetic filler can be prevented from falling off from the covering portion by forming the conductor post in such a manner. In addition, the magnetic filler can be prevented from falling off during handling or the like in steps after the third step.

According to the aspect, in the third step, the lid portion may be formed by polishing the outer surface of the covering portion. In this case, in the third step, since the covering portion is polished, the magnetic filler is likely to fall off in surroundings of the post portion. In contrast, since the lid portion is gradually formed during polishing by performing the polishing such that the lid portion is formed, the magnetic filler can be prevented from falling off from the covering portion in the third step.

DESCRIPTION OF THE PREFERRED EMBODIMENTS

Hereinafter, with reference to the drawings, various embodiments will be described in detail. In each of the drawings, the same reference signs will be applied to the same or corresponding parts, duplicated description will be omitted.

Figure 1:
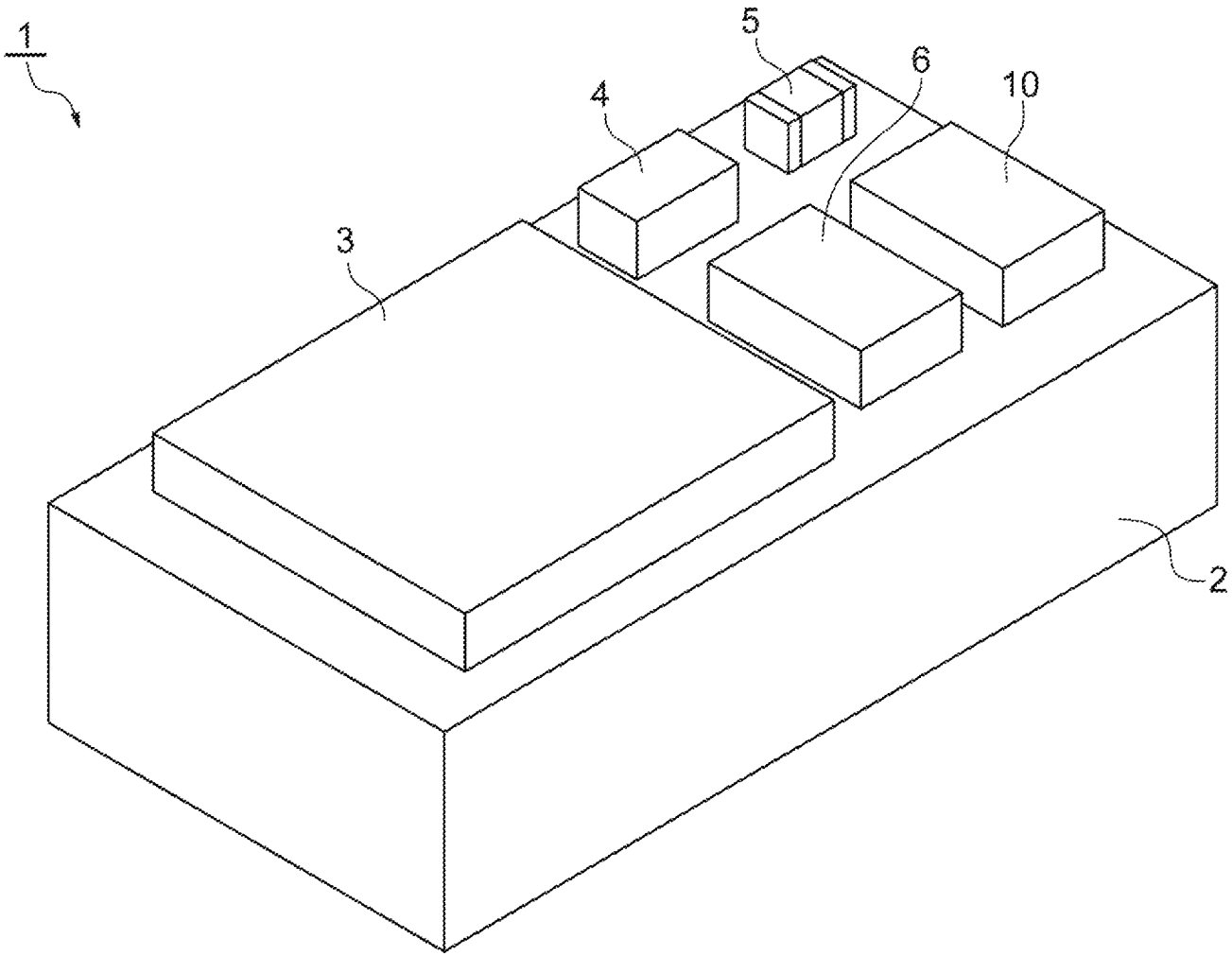
FIG. 1 is a perspective view illustrating a power supply circuit unit including a coil component according to an embodiment of the present disclosure.
Figure 2:
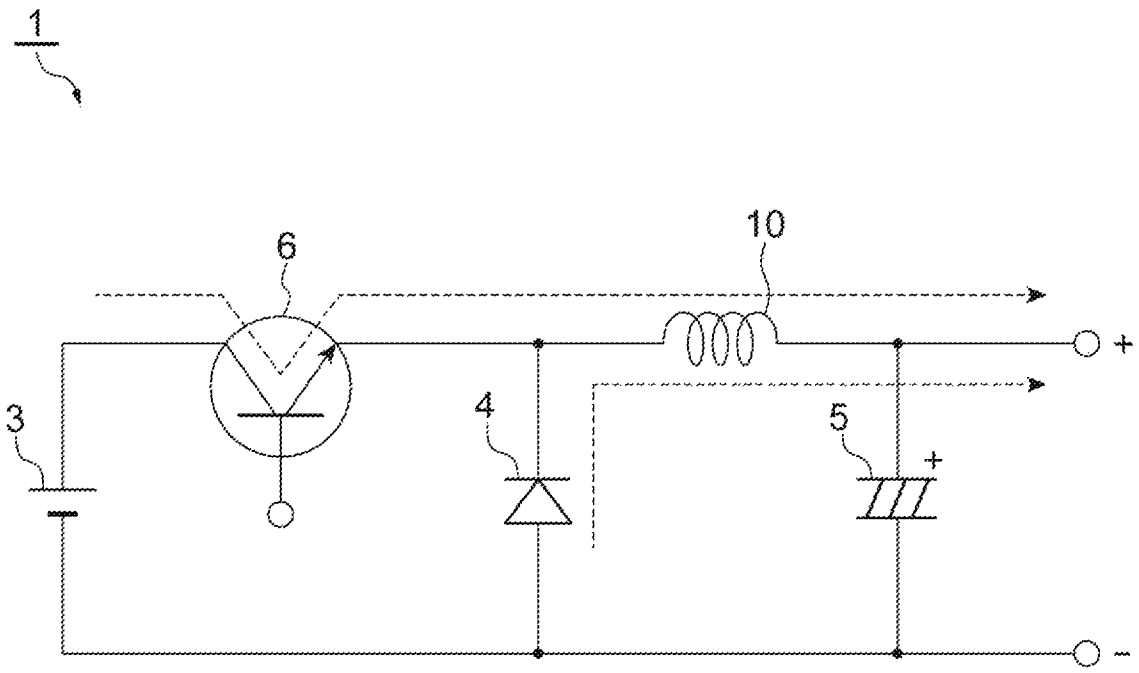
FIG. 2 is a view illustrating an equivalent circuit of the power supply circuit unit in FIG. 1.

First, with reference to FIGS. 1 and 2, an overall configuration of a power supply circuit unit 1 according to an embodiment of the present disclosure will be described. For example, a power supply circuit unit to be described in the present embodiment is a switching power supply circuit unit that converts (steps down) a direct voltage. As illustrated in FIGS. 1 and 2, the power supply circuit unit 1 includes a circuit substrate 2, electronic components 3, 4, 5, 6, and 10. Specifically, a power supply IC 3, a diode 4, a capacitor 5, a switching element 6, and a coil component 10 are configured to be mounted on the circuit substrate 2.

Figure 3:
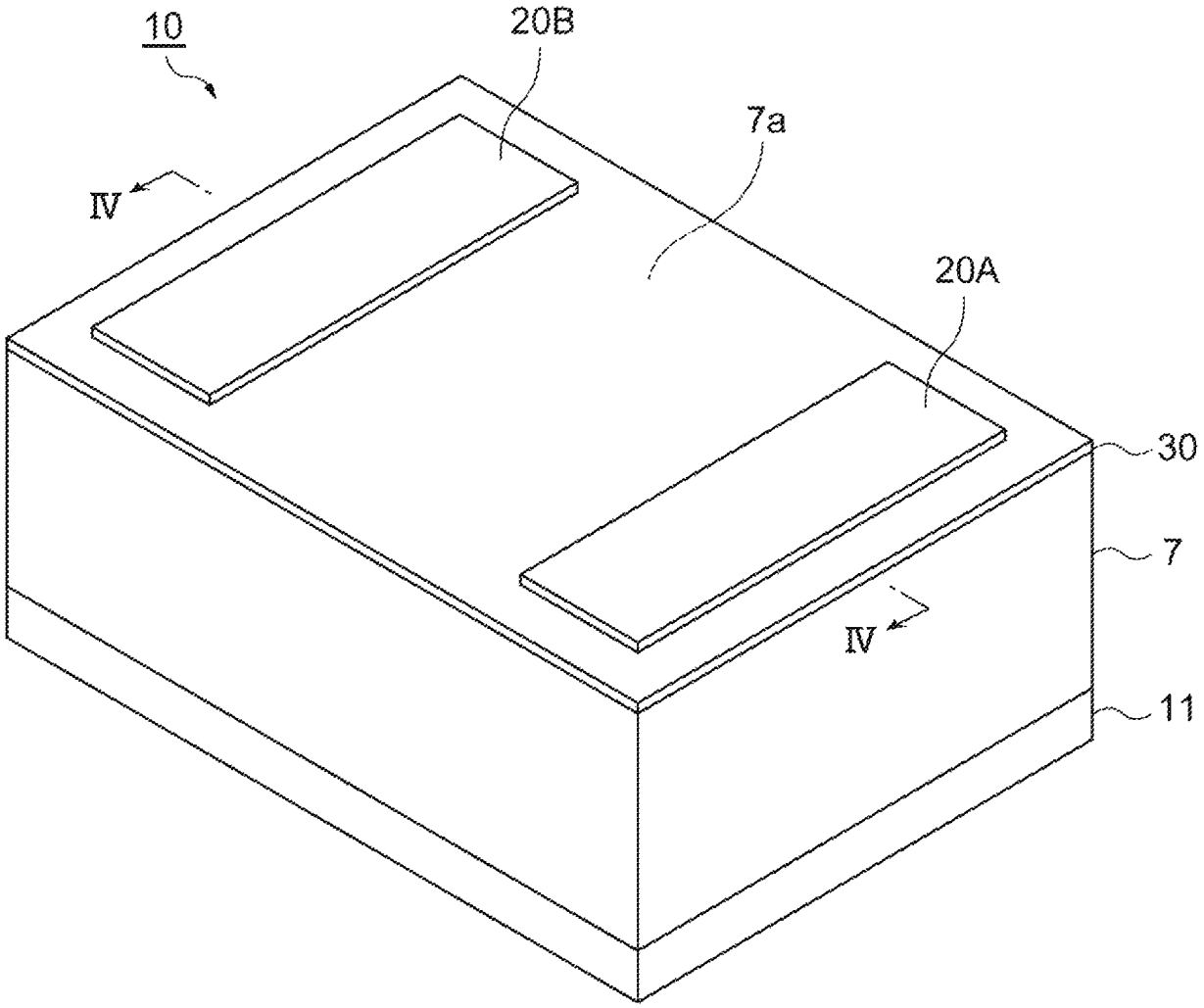
FIG. 3 is a perspective view illustrating the coil component according to the embodiment of the present disclosure.
Figure 4:
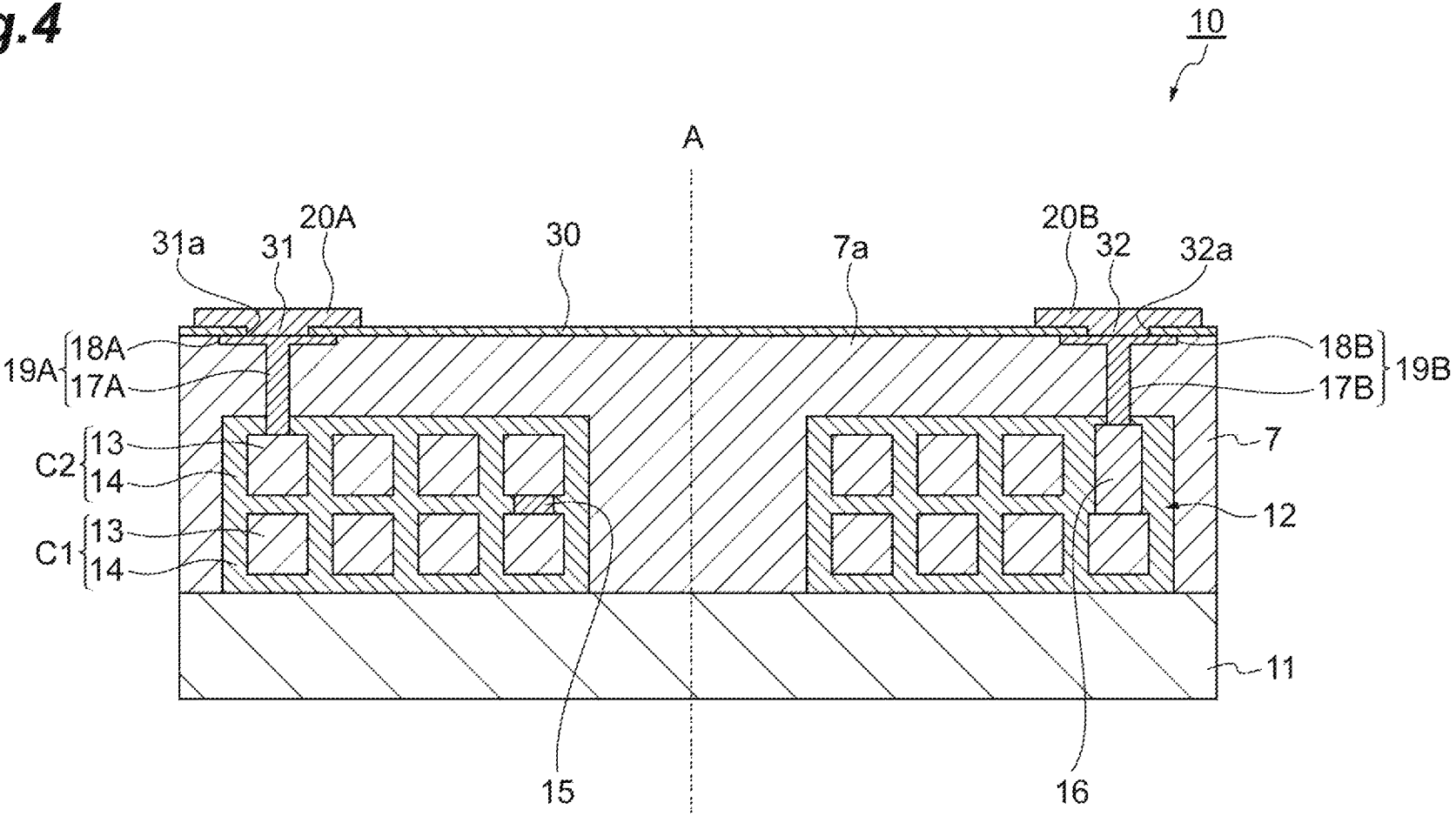
FIG. 4 is a cross-sectional view taken along line IV-IV in FIG. 3.
Figure 5:
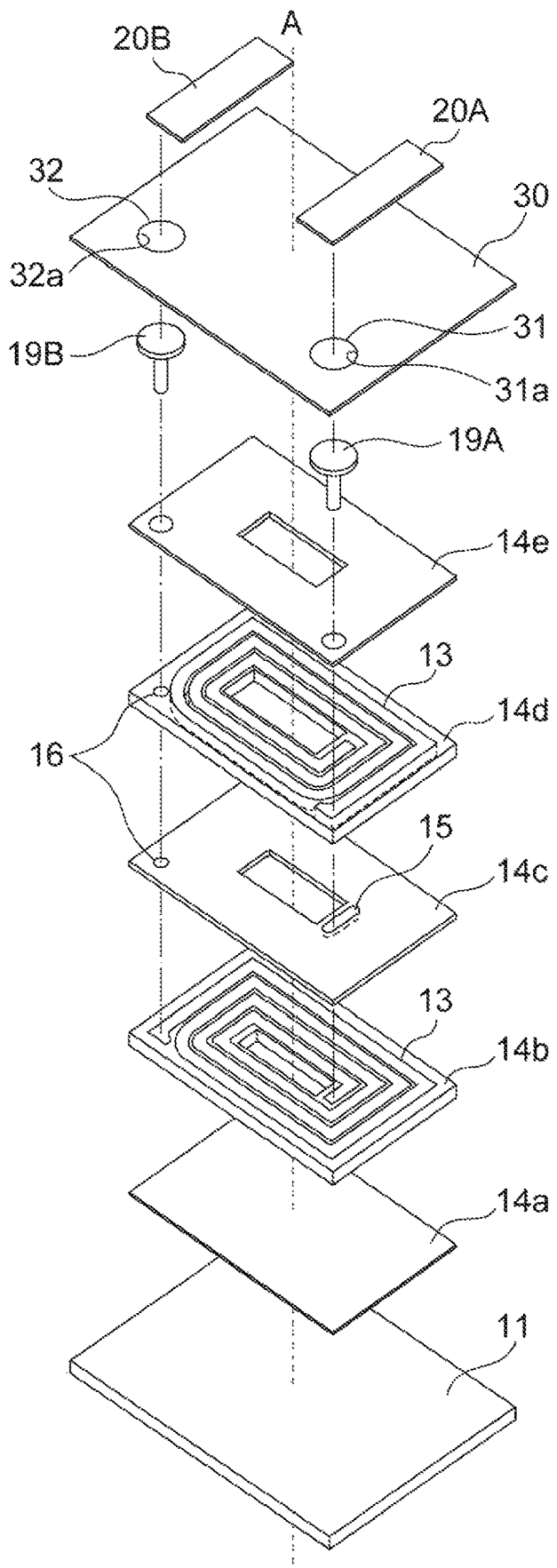
FIG. 5 is an exploded perspective view of the coil component in FIG. 3.

With reference to FIGS. 3 to 5, the configuration of the coil component 10 will be described. FIG. 3 is a perspective view of the coil component 10. FIG. 4 is a cross-sectional view taken along line IV-IV in FIG. 3. FIG. 5 is an exploded perspective view of the coil component. In the exploded perspective view of FIG. 5, illustration of a covering portion 7 in FIG. 3 is omitted.

As illustrated in FIG. 3, the coil component 10 includes a magnetic substrate 11, a coil portion 12, the covering portion 7, and conductor posts 19A and 19B.

The coil portion 12 is covered with the covering portion 7, and the covering portion 7 has a rectangular parallelepiped exterior. Examples of the rectangular parallelepiped shape include a rectangular parallelepiped shape having chamfered corners and ridge portions, and a rectangular parallelepiped shape having rounded corners and ridge portions. The covering portion 7 has an upper surface (outer surface) 7*a* and the upper surface 7*a* has a rectangular shape having long sides and short sides. Examples of the rectangular shape include a rectangle having rounded corners. A cover insulative layer 30 is stacked on the upper surface 7*a*. External terminals 20A and 20B are provided on the cover insulative layer 30.

The external terminal 20A is disposed along one short side of the upper surface 7*a*, and the external terminal 20B is disposed along the other short side of the upper surface 7*a*. The external terminals 20A and 20B are spaced away from each other in a direction along the long side of the upper surface 7*a*. The external terminals 20A and 20B are electrically connected to the conductor posts 19A and 19B, respectively.

For example, the magnetic substrate 11 is a substantially flat substrate constituted of a magnetic material such as ferrite (refer to FIG. 5). The magnetic substrate 11 is positioned on a side of the covering portion 7 which is opposite to the upper surface 7*a*.

The covering portion 7 is formed on the magnetic substrate 11 and internally includes the coil portion 12 (refer to FIGS. 4 and 5). The covering portion 7 is constituted of an insulative material. Specifically, the covering portion 7 is constituted of a mixture including magnetic fillers and binder resin (resin). Examples of the constituent material of the magnetic filler include iron, carbonyl iron, silicon, chromium, nickel, and boron. Examples of the constituent material of the binder resin include an epoxy resin. For example, 80 weight % or higher of the covering portion 7 in its entirety may be constituted of magnetic fillers. For example, the average particle diameter of the magnetic fillers can be set to range from 1 μm to 30 μm.

The coil portion 12 has annular coil-wound portions 13 and planar coils which each include an insulative layer 14 covering the coil-wound portion 13. The coil-wound portions 13 are insulated from each other by the insulative layers 14. The coil portion 12 has at least one layer of planar coil. In the present embodiment, the coil portion 12 has two layers of planar coils C1 and C2, and joining portions 15 and 16.

The planar coil C1 and the planar coil C2 each have an axial line (axial line A in FIGS. 4 and 5) orthogonal to the magnetic substrate 11, and the upper surface 7*a* of the covering portion 7. The planar coil C1 and the planar coil C2 are stacked along the direction of the axial line A. The planar coil C2 in the upper stage is positioned on the upper surface 7*a* side of the planar coil C1 in the lower stage. Each of the planar coils C1 and C2 has substantially the same exterior in a top view (specifically, the rectangular shape). The planar coil C1 and planar coil C2 have substantially the same dimensions. The planar coil C1 and the planar coil C2 exhibit rectangular ring shapes having the same outer edge dimensions and inner edge dimensions as each other in a top view, and forming regions thereof coincide with each other. Each of the coil-wound portion 13 of the planar coil C1 and the coil-wound portion 13 of the planar coil C2 is wound in a rectangular shape in the same layer. For example, each of the coil-wound portions 13 is constituted of a metal material such as Cu.

The insulative layer 14 has insulating characteristics and is constituted of an insulative resin. Examples of the insulative resin used for the insulative layer 14 include polyimide and polyethylene terephthalate. The insulative layers 14 integrally cover the planar coils C1 and C2 of the coil portion 12 inside the covering portion 7. The insulative layers 14 have a stacked structure and are constituted of in the present embodiment, five layers of insulative layers 14*a*, 14*b*, 14*c*, 14*d*, and 14*e* (refer to FIG. 5). The insulative layer 14*a* is positioned on a lower side (magnetic substrate 11 side) of the planar coil C1 in the lower stage and is formed in substantially the same region as the forming region of the coil portion 12 in a top view. The insulative layer 14*b* fills the periphery of the planar coil C1 within the same layer as the coil-wound portion 13 and gaps between windings. A region corresponding to the inner diameter of the coil portion 12 is vacant. The insulative layer 14*c* is at a position sandwiched between the planar coil C1 in the lower stage and the planar coil C2 in the upper stage. A region corresponding to the inner diameter of the coil portion 12 is open. The insulative layer 14*d* fills the periphery of the planar coil C2 within the same layer as the coil-wound portion 13 and gaps between windings. A region corresponding to the inner diameter of the coil portion 12 is open. The insulative layer 14*e* is positioned on an upper side (upper surface 7*a* side) of the planar coil C2 in the upper stage. A region corresponding to the inner diameter of the coil portion 12 is open.

The joining portion 15 is interposed between the planar coil C1 and the planar coil C2 and joins the winding on the innermost side of the coil-wound portion 13 of the planar coil C1 and the winding on the innermost side of the coil-wound portion 13 of the planar coil C2 to each other. The joining portion 16 extends from the planar coil C2 to the upper surface 7*a* side and joins the coil-wound portion 13 of the planar coil C2 and the conductor post 19B to each other.

For example, a pair of conductor posts 19A and 19B is constituted of Cu and is penetratingly provided in the covering portion 7 in a manner extending from both end portions of the coil portion 12 along the direction of the axial line A.

The conductor post 19A is connected to one end portion of the coil portion 12 provided in the outermost winding of the planar coil C2 in the upper stage. The conductor post 19A extends from the coil-wound portion 13 of the planar coil C2 to the upper surface 7*a* in a manner penetrating the covering portion 7 and is exposed to the upper surface 7*a*. The external terminal 20A is provided at a position corresponding to the exposed part of the conductor post 19A. The conductor post 19A is connected to the external terminal 20A through a conductor portion 31 inside a through-hole (opening) 31*a* of the cover insulative layer 30. Accordingly, one end portion of the coil portion 12 and the external terminal 20A are electrically connected to each other via the conductor post 19A and the conductor portion 31.

The conductor post 19B is connected to the other end portion of the coil portion 12 provided in the outermost winding of the planar coil C1. The conductor post 19B extends from the coil-wound portion 13 of the planar coil C1 to the upper surface 7*a* in a manner penetrating the covering portion 7 and is exposed to the upper surface 7*a*. The external terminal 20B is provided at a position corresponding to the exposed part of the conductor post 19B. The conductor post 19B is connected to the external terminal 20B through a conductor portion 32 inside a through-hole (opening) 32*a* of the cover insulative layer 30. Accordingly, the other end portion of the coil portion 12 and the external terminal 20B are electrically connected to via the conductor post 19B and the conductor portion 32.

Each of a pair of external terminals 20A and 20B provided on the upper surface 7*a* of the covering portion 7 has a film shape and has a substantially rectangular shape in a top view. The external terminals 20A and 20B have areas substantially the same as each other. For example, the external terminals 20A and 20B are constituted of a conductive material such as Cu. The external terminals 20A and 20B are plating electrodes formed by performing plating forming. The external terminals 20A and 20B may have a single-layer structure or a multi-layer structure.

The cover insulative layer 30 is provided on the upper surface 7*a* of the covering portion 7 and is sandwiched between the conductor posts 19A and 19B and the external terminals 20A and 20B in a direction along the axial line A. The cover insulative layer 30 has the through-holes (opening) 31*a* and 32*a* at positions respectively corresponding to the conductor posts 19A and 19B. The conductor portions 31 and 32 constituted of a conductive material such as Cu are provided inside the through-holes 31*a* and 32*a*. The cover insulative layer 30 is constituted of an insulative material. For example, the cover insulative layer 30 is constituted of an insulative resin such as polyimide and epoxy.

Figure 6:
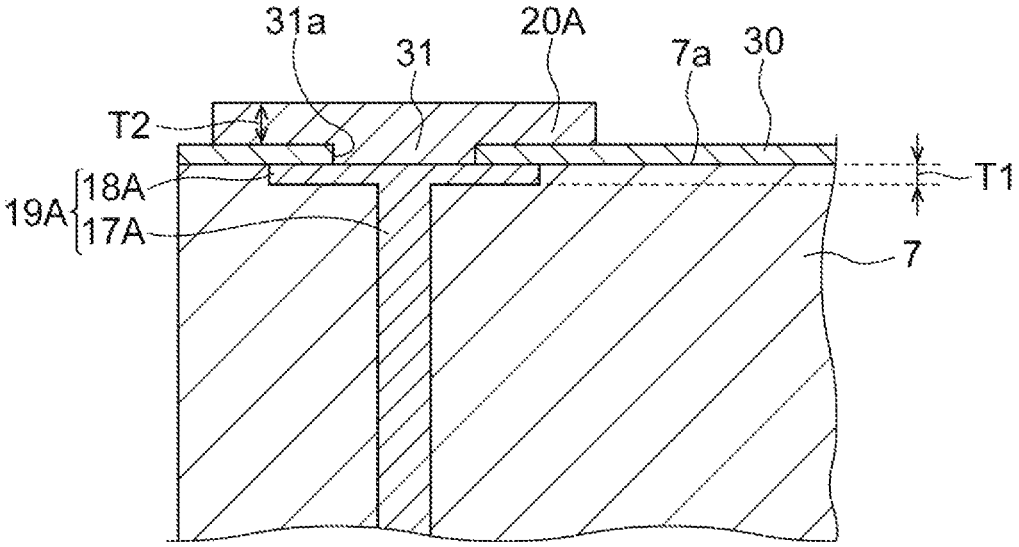
FIG. 6 is an enlarged view schematically illustrating a structure of a connection portion between a conductor post and an external terminal.
Figure 7:
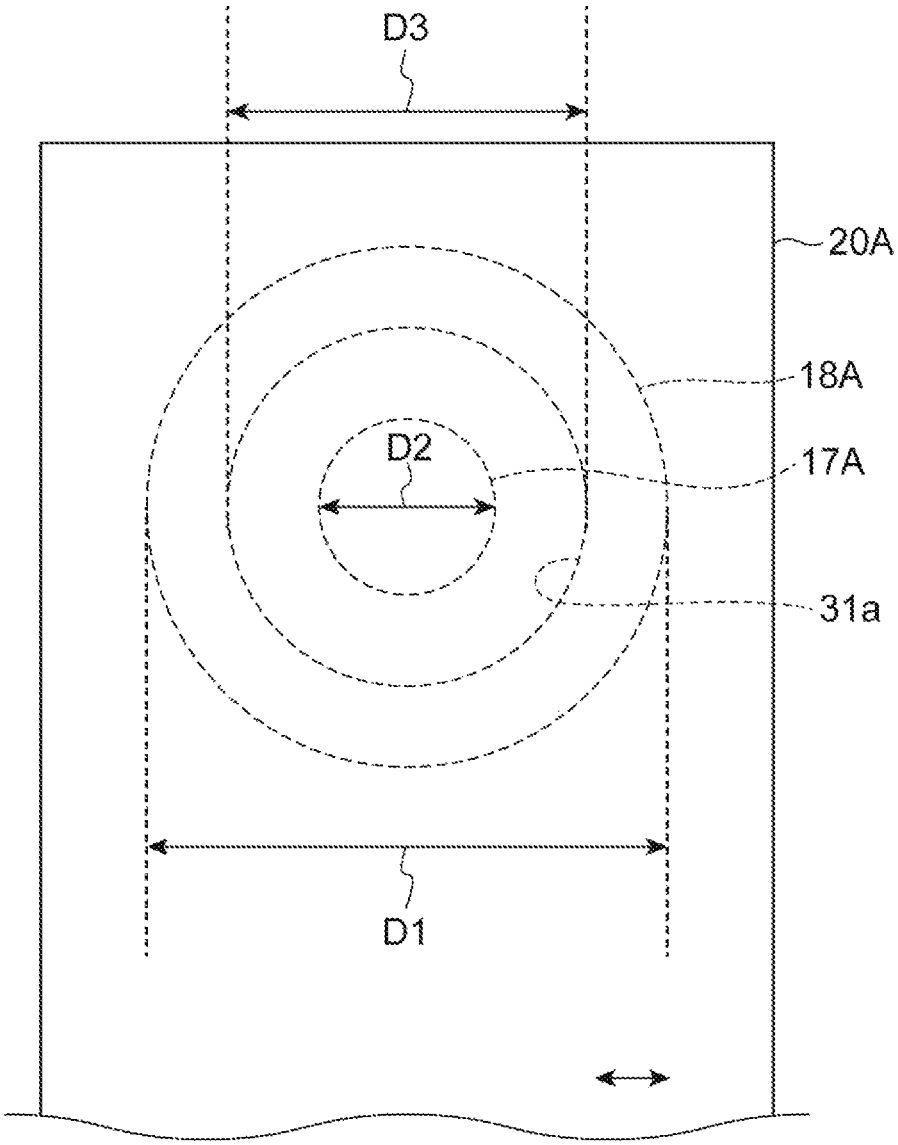
FIG. 7 is a top view illustrating a part of the external terminal.
Figure 8:
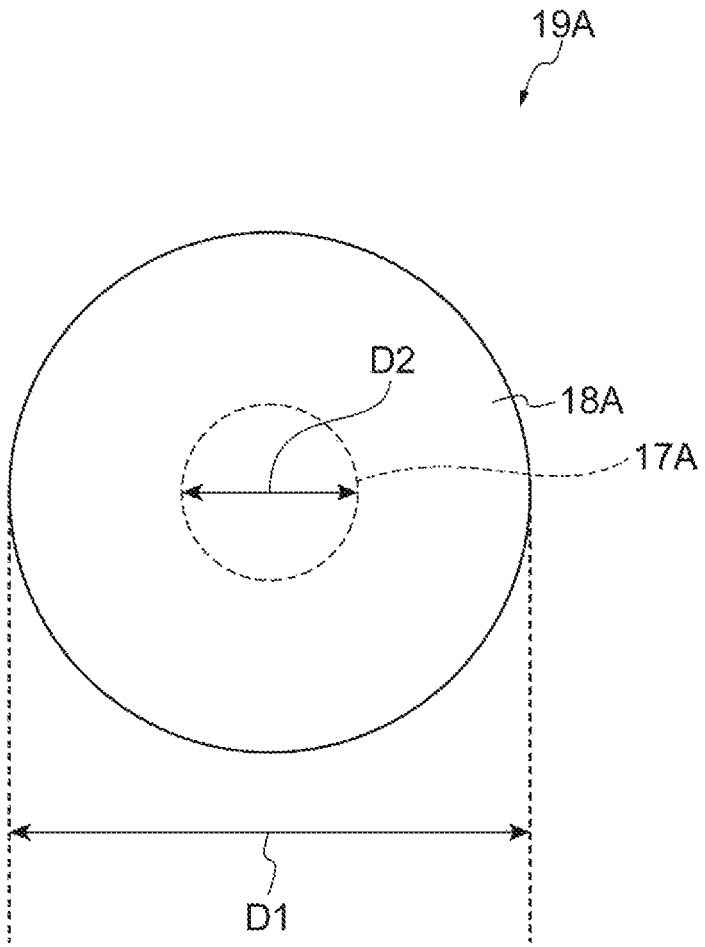
FIG. 8 is a top view illustrating the conductor post.

Next, with reference to FIGS. 6, 7, and 8, structures of the conductor posts 19A and 19B, the external terminals 20A and 20B, and the cover insulative layer 30 will be described in detail. FIG. 6 is an enlarged view schematically illustrating a structure of a connection portion between a conductor post and an external terminal. FIG. 7 is a top view illustrating a part of the external terminal. FIG. 8 is a top view illustrating the conductor post. Since the structure of the connection portion between the conductor post 19A and the external terminal 20A, and the structure of the connection portion between the conductor post 19B and the external terminal 20B are substantially the same as each other. Therefore, in FIGS. 6, 7, and 8, only the structure of the connection portion between the conductor post 19A and the external terminal 20A is illustrated, and description of the structure of the connection portion between the conductor post 19A and the external terminal 20A will be omitted.

As illustrated in FIGS. 6, 7, and 8, the conductor post 19A has a post portion 17A extending in the axial line A direction of the planar coils C1 and C2 (refer to FIGS. 4 and 5) from the coil-wound portion 13, and a lid portion 18A extending from an end portion of the post portion 17A on the upper surface 7*a* side along the surface direction of the upper surface 7*a*. The lid portion 18A is exposed from the covering portion 7 on the upper surface 7*a*, and the top surface of the lid portion 18A forms the same plane as the upper surface 7*a* of the covering portion 7. The post portion 17A extends straight along the direction of the axial line A. The post portion 17A and the lid portion 18A are integrally provided and are constituted of the same conductive material as each other. In the present embodiment, a corner defined by the post portion 17A and the lid portion 18A is substantially a right angle. However, the corner may be configured to be curved. The conductor portion 31 is connected to the lid portion 18A of the conductor post 19A.

In a top view, the post portion 17A, the lid portion 18A, and the through-hole 31*a* of the cover insulative layer 30 have a substantially circular shape. In addition, in a top view, the central positions of the post portion 17A, the lid portion 18A, and the through-hole 31*a* are substantially the same. In a plane along the upper surface 7*a*, the area of the region in which the external terminal 20A is formed and the area of the region in which the lid portion 18A is formed are wider than the area of the region in which the through-hole 31*a* is formed. In addition, a cross-sectional area of the post portion 17A in a cross section on a plane orthogonal to a direction along the axial line A (refer to FIGS. 4 and 5) of the planar coils C1 and C2 is smaller than the area of the through-hole 31*a*. In the present embodiment, since the post portion 17A, the lid portion 18A, and the through-hole 31*a* have a substantially circular shape in a top view, in a direction along the upper surface 7*a*, dimensions D1 of the lid portion 18A (that is, dimensions in a direction along the surface direction of the upper surface 7*a*) are greater than dimensions D2 of the post portion 17A. In the present embodiment, the dimensions D1 of the lid portion 18A in a direction along the surface direction of the upper surface 7*a* are 1.1 times or greater than the dimensions D2 of the post portion 17A. Dimensions D3 of the through-hole 31*a* of the cover insulative layer 30 are greater than the dimensions D2 of the post portion 17A and smaller than the dimensions D1 of the lid portion 18A. Accordingly, the cover insulative layer 30 is sandwiched between the lid portion 18A and the external terminal 20A. That is, both the region in which the external terminal 20A is formed and the region in which the lid portion 18A is formed overlap the entire region in which the through-hole 31*a* is formed. A thickness T1 of the lid portion 18A is smaller than a thickness T2 of the external terminal 20A. In addition, when seen in a direction along the axial line A (refer to FIGS. 4 and 5), the entire region, in which the lid portion 18A is formed, is covered with the external terminal 20A. As an example, the dimensions D1 of the lid portion 18A can be set to range approximately from 150 μm to 550 μm, the dimensions D2 of the post portion 17A can be set to range approximately from 50 μm to 500 μm, and the dimensions D3 of the through-hole 31*a* can be set to range approximately from 100 μm to 400 μm. The central positions of the post portion 17A, the lid portion 18A, and the through-hole 31*a* may be substantially the same, and there may be a deviation ranging approximately from 5 μm to 50 μm due to an manufacturing error and the like.

Next, with reference to FIGS. 9A to 9D, 10A to 10D, and 11A to 11D, a method of manufacturing a coil component 10 will be described. FIGS. 9A to 9D, 10A to 10D, and 11A to 11D are views describing a step of manufacturing a coil component 10.

Figure 9A:
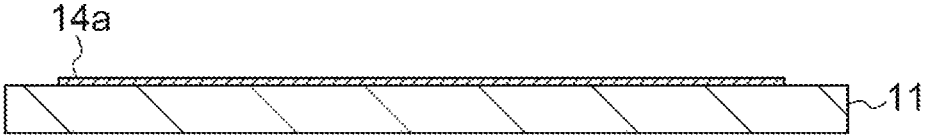
FIGS. 9A to 9D are views describing a step of manufacturing a coil component.
Figure 9B:
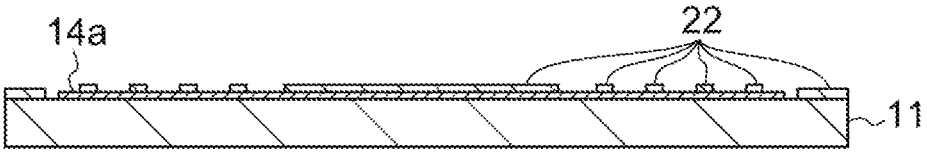
Figure 9C:
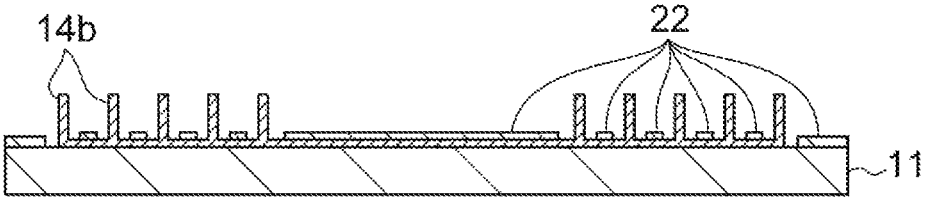
Figure 9D:
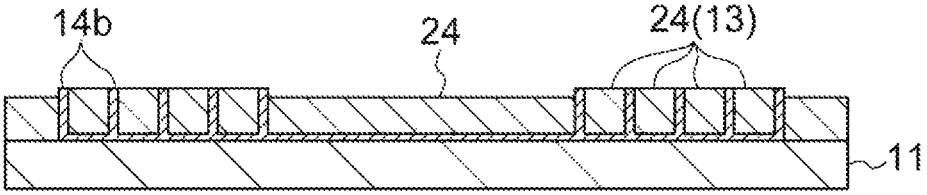

First, the coil portion 12 is formed on the magnetic substrate 11 (first step). Specifically, as illustrated in FIG. 9A, the insulative layer 14*a* is formed by coating the magnetic substrate 11 with an insulative paste pattern. Subsequently, as illustrated in FIG. 9B, seed portions 22 for performing plating forming of the coil-wound portion 13 of the planar coil C1 on the insulative layer 14*a* are formed. The seed portions 22 can be formed through plating, sputtering, or the like using a predetermined mask. Subsequently, as illustrated in FIG. 9C, the insulative layer 14*b* is formed. The insulative layer 14*b* can be acquired by coating the entire surface of the magnetic substrate 11 with an insulative resin paste, and removing parts corresponding to the seed portions 22 thereafter. That is, the insulative layer 14*b* functions to cause the seed portions 22 to be exposed. The insulative layer 14*b* is a part having a wall shape erected on the magnetic substrate 11 and defines a region in which the coil-wound portion 13 of the planar coil C1 is formed. Subsequently, as illustrated in FIG. 9D, a plating layer 24 is formed by using the seed portions 22 between the insulative layers 14*b*. In this case, the plated spot which grows in a manner filling the region defined between the insulative layers 14*b* becomes the coil-wound portion 13 of the planar coil C1. As a result, the winding of the planar coil C1 is positioned between the insulative layers 14*b* adjacent to each other.

Figure 10A:
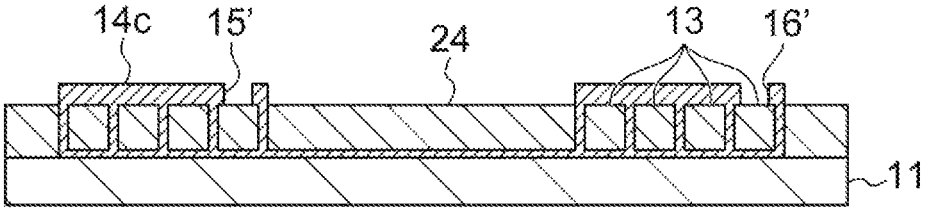
FIGS. 10A to 10D are views describing a step of manufacturing a coil component.
Figure 10B:
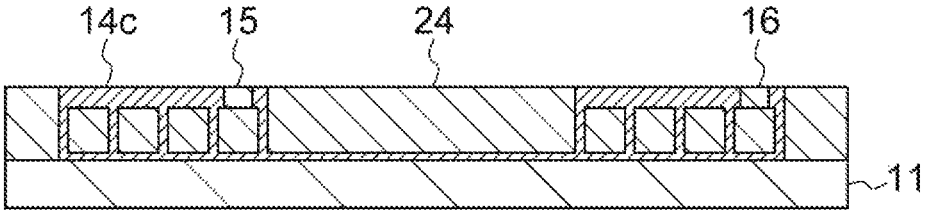

Subsequently, as illustrated in FIG. 10A, the insulative layer 14*c* is formed by coating the planar coil C1 with an insulative resin paste pattern. In this case, openings 15' and 16' for forming the joining portions 15 and 16 are formed in the insulative layer 14*c*. Subsequently, as illustrated in FIG.

10B, plating forming of the joining portions 15 and 16 is performed with respect to the openings 15' and 16' the insulative layer 14*c*.

Figure 10C:
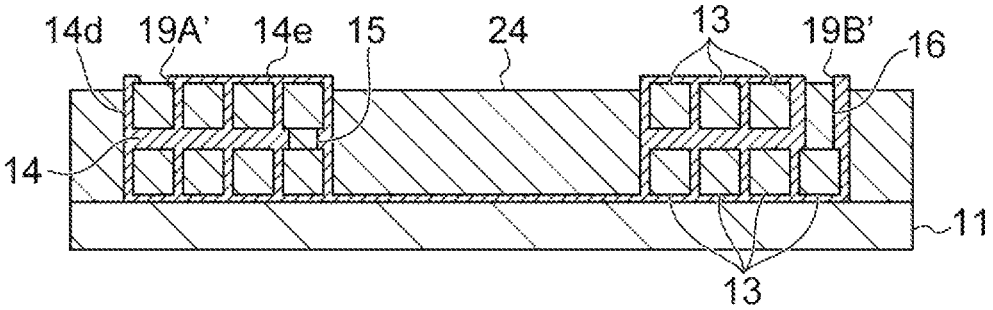

Subsequently, as illustrated in FIG. 10C, similar to the steps described above, the coil-wound portion 13 of the planar coil C2 and the insulative layer 14*d* and 14*e* are formed on the insulative layer 14*c*. Specifically, similar to the procedure illustrated in FIGS. 9B to 9D, seed portions for performing plating forming of the coil-wound portion 13 of the planar coil C2 are formed, the insulative layer 14*d* defining the region for forming the coil-wound portion 13 of the planar coil C2 is formed, and plating forming of the coil-wound portion 13 of the planar coil C2 is performed between the insulative layers 14*d*.

Then, the insulative layer 14*e* is formed by coating the coil-wound portion 13 of the planar coil C2 with an insulative resin paste pattern. In this case, opening portions 19A' and 19B' for forming the conductor posts 19A and 19B are formed in the insulative layer 14*e*. In this manner, the insulative layer 14 has a stacked structure including the plurality of insulative layers 14*a* to 14*e*, and the coil-wound portions 13 of the planar coils C1 and C2 are in a state of being surrounded by the insulative layers 14*a* to 14*e*. The coil portion 12 is formed through the steps described above.

Figure 10D:
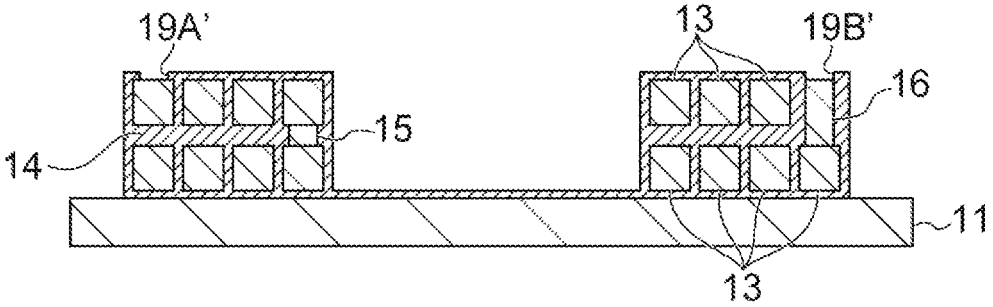

Subsequently, as illustrated in FIG. 10D, in the plating layer 24, parts in which the coil-wound portions 13 of the planar coils C1 and C2 are not configured (parts corresponding to the inner diameter portion and the outer circumferential portion of the planar coils C1 and C2) are removed by performing etching or the like. In other words, the plating layer 24 which is not covered with the insulative layer 14 FIG. 10C is removed.

Figure 11A:
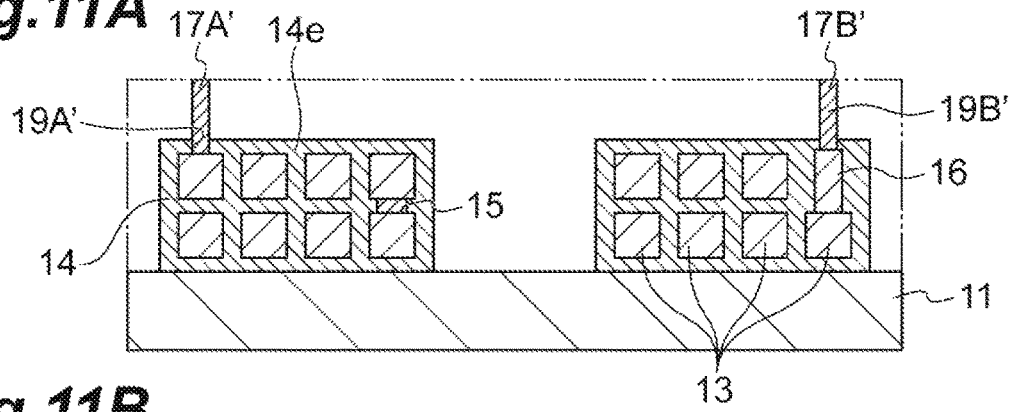
FIGS. 11A to 11D are views describing a step of manufacturing a coil component.

Subsequently, lead-out conductors 17A' and 17B' which become the post portions 17A and 17B of the conductor posts 19A and 19B are formed. First, as illustrated in FIG. 11A, the lead-out conductor 17A' which becomes the post portion 17A of the conductor post 19A is formed at a position corresponding to the opening portion 19A' of the insulative layer 14*e*, and the lead-out conductor 17B' which becomes the post portion 17B of the conductor post 19B is formed at a position corresponding to the opening portion 19B'. Specifically, seed portions for the lead-out conductors 17A' and 17B' are formed on the opening portions 19A' and 19B' through plating, sputtering, or the like using a predetermined mask, and plating forming of the lead-out conductors 17A' and 17B' is performed by using the seed portions. When plating forming of the lead-out conductors 17A' and 17B' is performed, an insulative sacrificing layer (part indicated with two-dot chain line) can be used, for example.

Figure 11B:
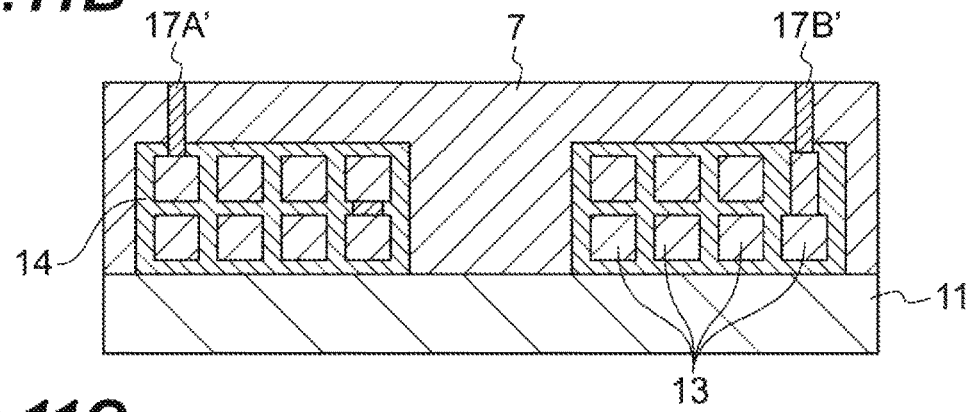
Figure 11C:
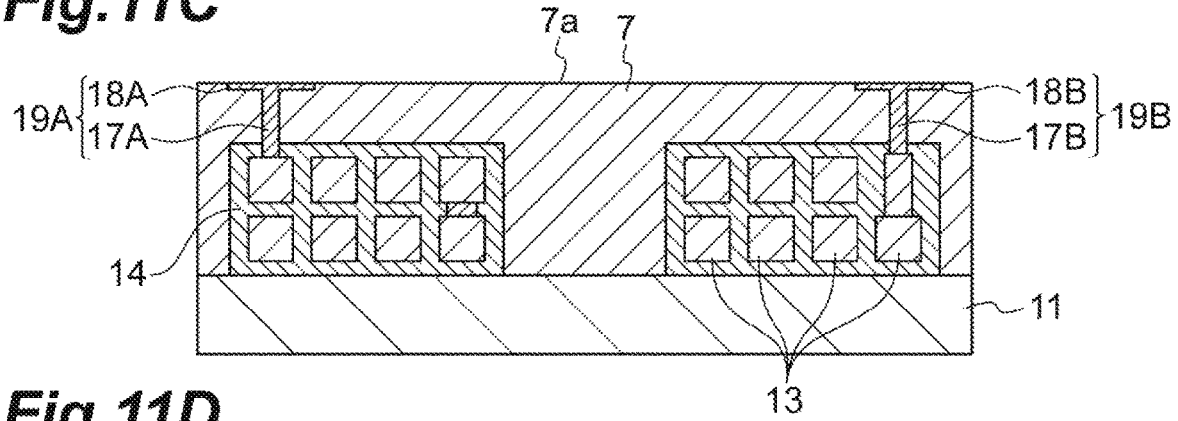

Subsequently, as illustrated in FIG. 11B, the entire surface of the magnetic substrate 11 is coated with a magnetic resin including magnetic fillers and resin, and predetermined hardening is performed, thereby forming the covering portion 7 (second step). Accordingly, the periphery of the lead-out conductors 17A' and 17B' is covered with the covering portion 7. In this case, the inner diameter part of the coil portion 12 is filled with the covering portion 7. Subsequently, as illustrated in FIG. 11C, the conductor posts 19A and 19B are formed (third step). Specifically, the covering portion 7 and the lead-out conductors 17A' and 17B' are polished. Accordingly, the lead-out conductors 17A' and 17B' are exposed from the covering portion 7, and the lead-out conductors 17A' and 17B' are stretched by further continuing polishing. In this manner, the conductor posts 19A and 19B having the post portions 17A and 17B and the lid portions 18A and 18B are formed from the lead-out conductors 17A' and 17B'. In addition, the upper surface 7*a* of the covering portion 7 is in a state of being formed. The dimensions D1 of the lid portions 18A and 18B can be adjusted by changing the polishing time. For example, the dimensions D1 of the lid portions 18A and 18B increase as the polishing time is lengthened. In addition, for example, the shapes of the lid portions 18A and 18B can be adjusted by changing the direction of polishing.

Figure 11D:
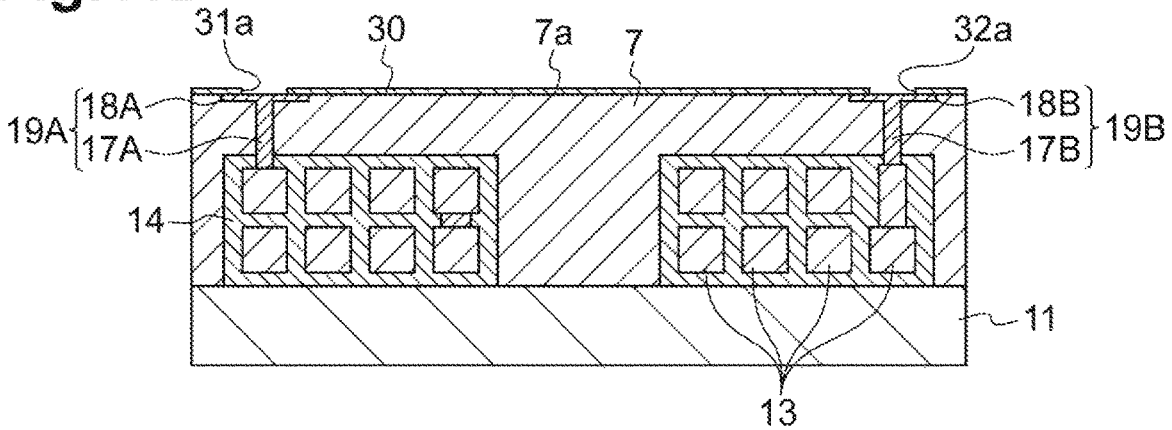

Subsequently, as illustrated in FIG. 11D, before plating forming of the external terminals 20A and 20B is performed, the upper surface 7*a* is coated with an insulative material such as an insulative resin paste, thereby forming the cover insulative layer 30. When the cover insulative layer 30 is formed, the entire upper surface 7*a* is covered, and the through-holes 31*a* and 32*a* are formed at positions corresponding to the pair of conductor posts 19A and 19B, thereby causing the pair of conductor posts 19A and 19B to be exposed from the cover insulative layer 30. Specifically, for the moment, the entire region of the upper surface 7*a* is coated with an insulative material. Thereafter, the cover insulative layer 30 at locations corresponding to the conductor posts 19A and 19B are removed.

Then, seed portions (not illustrated) are formed in the regions corresponding to the external terminals 20A and 20B on the cover insulative layer 30 through plating, sputtering, or the like using a predetermined mask. The seed portions are also formed on the lid portions 18A and 18B of the conductor posts 19A and 19B exposed from the through-holes 31*a* and 32*a* of the cover insulative layer 30. Subsequently, the external terminals 20A and 20B are formed through electroless plating by using the seed portions. In this case, the plated spot grows in a manner filling the through-holes 31*a* and 32*a* of the cover insulative layer 30 and forms the conductor portions 31 and 32, thereby forming the external terminals 20A and 20B on the cover insulative layer 30. The coil component 10 is formed through the steps described above.

Figure 12:
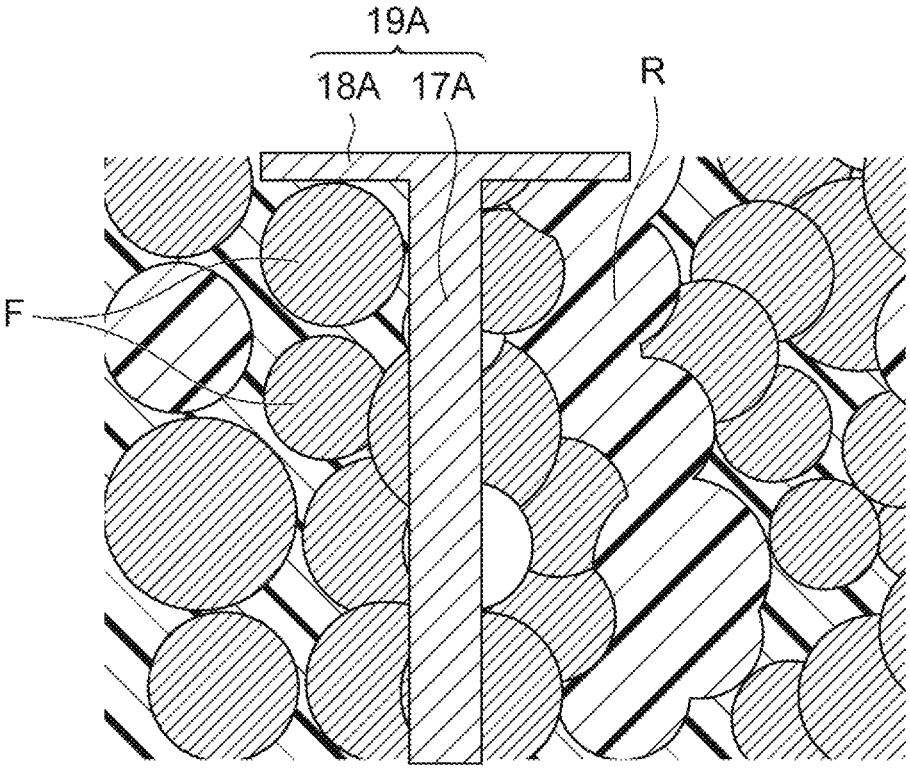
FIG. 12 is a view for describing an operation of the conductor post of the coil component illustrated in FIG. 4.
Figure 13:
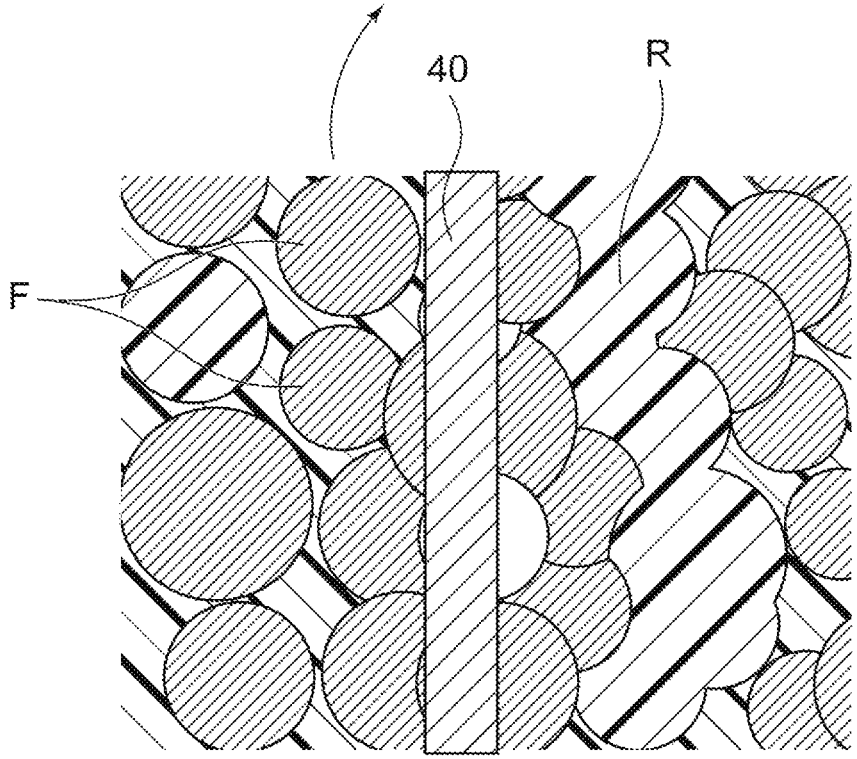
FIG. 13 is a view schematically illustrating a conductor post according to a comparative example.

Next, with reference to FIGS. 12 and 13, an operational effect of the conductor posts 19A and 19B will be described. FIG. 12 is a view for describing an operation of the conductor post of the coil component illustrated in FIG. 4. FIG. 13 is a view schematically illustrating a conductor post according to a comparative example. As illustrated in FIGS. 12 and 13, the covering portion 7 includes a resin R for connecting a magnetic filler F and another magnetic filler F with each other.

As illustrated in FIG. 13, a conductor post 40 according to the comparative example has no lid portion extending along the upper surface 7*a*. In this case, since the conductor post 40 and the magnetic fillers are constituted of materials different from each other, adhesion therebetween is low, and the magnetic fillers are likely to fall off in surroundings of the conductor post 40. In contrast, as illustrated in FIG. 12, since the conductor post 19A (conductor post 19B) of the coil component 10 according to the present embodiment has the lid portion 18A (lid portion 18B), the covering portion is in a state of being covered with the lid portion in surroundings of the conductor post 19A (conductor post 19B). Therefore, even though adhesion between the magnetic fillers and the conductor post 19A (conductor post 19B) is low, the magnetic fillers are held by the lid portion 18A (lid portion 18B), so that the magnetic fillers can be prevented from falling off from the covering portion.

As described above, the conductor posts 19A and 19B of the coil component 10 has the post portions 17A and 17B which extend in the axial line A direction of the planar coils C1 and C2 from the coil-wound portion 13, and the lid portions 18A and 18B which extend along the surface direction of the upper surface 7*a* from the end portions of the post portions 17A and 17B on the upper surface 7*a* side. Since the lid portions 18A and 18B are provided in this manner, the covering portion 7 around the post portions 17A and 17B is covered with the lid portions 18A and 18B of the conductor posts 19A and 19B. Therefore, in the covering portion 7 covered with the lid portions 18A and 18B of the conductor posts 19A and 19B, the magnetic filler F can be prevented from falling off from the covering portion 7.

In addition, the dimensions D1 of the lid portions 18A and 18B in a direction along the surface direction of the upper surface 7*a* are ten times or greater than the average particle diameter of the magnetic filler F. Accordingly, the lid portions 18A and 18B are increased in size ten times or greater than the magnetic filler F, so that the magnetic filler F can be more effectively prevented from falling off from the covering portion 7.

In addition, the dimensions D1 of the lid portions 18A and 18B in a direction along the surface direction of the upper surface 7*a* are twice or greater than the dimensions D2 of the post portions 17A and 17B. Accordingly, the area of the covering portion 7 covered with the lid portions 18A and 18B can be increased, so that the magnetic filler F can be more effectively prevented from falling off from the covering portion 7.

In addition, the ratio of the magnetic filler F included in the covering portion 7 is 80 weight % or higher. In order to increase saturation magnetic flux density of the covering portion 7, the ratio of the magnetic filler F included in the covering portion 7 can be high. However, if the ratio of the magnetic filler F increases, the amount of the resin R which functions as a binder connecting the magnetic fillers F with each other is reduced. Accordingly, the magnetic filler F is likely to fall off. In contrast, according to the coil component 10, since the covering portion 7 around the conductor posts 19A and 19B is covered with the lid portions 18A and 18B, even if the ratio of the magnetic filler F is 80 weight % or higher at which the magnetic filler F is likely to fall off, saturation magnetic flux density of the covering portion 7 can be improved and the magnetic filler F can be prevented from falling off.

In addition, according to the method of manufacturing the coil component 10 according to the present embodiment, in the third step, the lid portions 18A and 18B extending from the end portions of the post portions 17A and 17B on the upper surface 7*a* side along the upper surface 7*a* are formed. Accordingly, in surroundings of the post portions 17A and 17B, the covering portion 7 is in a state of being covered with the lid portions 18A and 18B. Therefore, the magnetic filler F can be prevented from falling off from the covering portion 7 by forming the conductor posts 19A and 19B in such a manner. In addition, the magnetic filler F can be prevented from falling off during handling or the like in steps after the third step.

In addition, in the third step, the lid portions 18A and 18B is formed by polishing the upper surface 7*a* of the covering portion 7. In a case where the covering portion 7 is polished in this manner, the magnetic filler F is likely to fall off in surroundings of the post portions 17A and 17B. In contrast, since the lid portions 18A and 18B are gradually formed during polishing by performing the polishing such that the lid portions 18A and 18B are formed, the magnetic filler F can be prevented from falling off from the covering portion 7 in the third step. In this case, bonding portions between the post portions 17A and 17B and the lid portions 18A and 18B may have a structure in which a cross section forms a gently curved surface.

In a case where a terminal electrode is provided on a side surface of a coil component as in the coil component disclosed in Patent Literature 1, the terminal electrode is generally formed by a plating method. Compared to a thin film technology using photolithography, the plating method has been known that formed electrodes have poor dimensional accuracy. However, thin film technology cannot be applied in forming an electrode on a side surface of the coil component. Therefore, the inventors of this application have repeatedly studied a technology of providing a terminal electrode on the upper surface of a coil component in order to form an electrode using the thin film technology.

In a case where a terminal electrode is provided on an upper surface of a coil component, the conductor post for connecting the terminal electrode and a coil with each other is required to be penetratingly provided inside a magnetic layer. In this case, in order to retain reliability of connection between the conductor post and the terminal electrode, there is a need to ensure a contact area between the conductor post and the terminal electrode to a certain extent. However, since magnetic layers are regulated to have predetermined external dimensions, if a conductor post is increased in volume, the volume of the magnetic layer has to be reduced as much as the volume of the conductor post is increased. Therefore, it is also required to prevent deterioration of saturation magnetic flux density caused due to reduction of the volume of the magnetic layer.

In the coil component 10 according to the present embodiment, the conductor posts 19A and 19B of the coil component 10 have the post portions 17A and 17B extending the axial line A direction, and the lid portions 18A and 18B extending from the end portions of the post portions 17A and 17B on the upper surface 7*a* side along the upper surface 7*a*. The areas of the post portions 17A and 17B in a plane along the upper surface 7*a* are smaller than the areas of the lid portions 18A and 18B. In this manner, the lid portions 18A and 18B having relatively significant areas are provided in parts in which the conductor posts 19A and 19B and the external terminals 20A and 20B are connected to each other, and the areas of the post portions 17A and 17B are caused to be relatively small. Accordingly, the contact areas between the conductor posts 19A and 19B and the external terminals 20A and 20B can be ensured, and the volume of the covering portion 7 can be prevented from being reduced. Therefore, reliability of electrical connection of the coil component 10 can be retained, and deterioration of saturation magnetic flux density can be prevented. In addition, in a plane along the upper surface 7*a*, the areas of the external terminals 20A and 20B and the areas of the lid portions 18A and 18B are wider than the areas of the through-holes 31*a* and 32*a*. Since the lid portions 18A and 18B are provided in this manner, connection areas between the external terminals 20A and 20B and the conductor posts 19A and 19B are regulated by the areas of the through-holes 31*a* and 32*a* of the cover insulative layer 30. Therefore, it is possible to prepare connection structures between the conductor posts 19A and 19B and the external terminals 20A and 20B having dimensions as designed.

In addition, cross-sectional areas of the post portions 17A and 17B in a cross section on a plane orthogonal to the axial line A direction of the planar coils C1 and C2 are smaller than the areas of the through-holes 31*a* and 32*a*. Accordingly, the volume of the post portions 17A and 17B can be reduced, and the volume of the covering portion 7 can be further prevented from being reduced. Therefore, deterioration of saturation magnetic flux density of the coil component 10 can be further prevented. In addition, since the lid portions 18A and 18B are provided, even in a case where the areas of the post portions 17A and 17B are smaller than the areas of the through-holes 31*a* and 32*a* of the cover insulative layer 30, the connection areas between the conductor posts 19A and 19B and the external terminals 20A and 20B can be prevented from being reduced.

In addition, the entire regions, in which the lid portions 18A and 18B are formed, are covered with the external terminals 20A and 20B when seen in the axial line A direction of the planar coils C1 and C2. Accordingly, the volume of the lid portions 18A and 18B can be reduced, and the volume of the covering portion 7 can be further prevented from being reduced. Therefore, deterioration of saturation magnetic flux density of the coil component 10 can be further prevented.

In addition, the thicknesses T1 of the lid portions 18A and 18B are smaller than the thicknesses T2 of the external terminals 20A and 20B. Accordingly, the volume of the lid portions 18A and 18B can be reduced, and the volume of the covering portion 7 can be further prevented from being reduced. Therefore, deterioration of saturation magnetic flux density of the coil component 10 can be further prevented.

Figure 14:
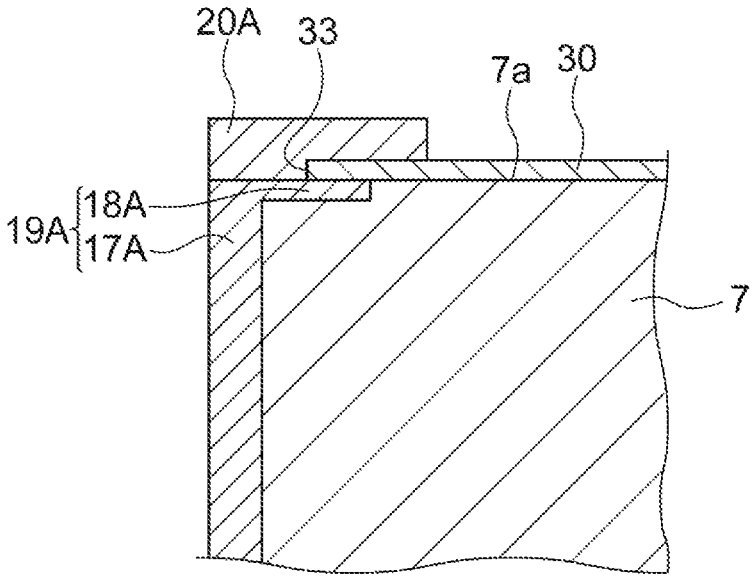
FIG. 14 is a cross-sectional view illustrating a modification example of the conductor post in FIG. 7.

Hereinabove, the embodiment of the present disclosure has been described. However, the present disclosure is not limited to the embodiment described above and may be modified or differently applied within a range not changing the gist disclosed in each of the aspects. In the embodiment described above, the lid portions 18A and 18B extend along the upper surface 7*a* mainly having the post portions 17A and 17B as centers. However, the lid portions 18A and 18B do not have to have the post portions 17A and 17B as centers. For example, as illustrated in FIG. 14, the lid portion 18A (lid portion 18B) may extend to only one side along the upper surface 7*a* from the post portion 17A. In this case, the shapes of the post portion 17A and the lid portion 18A in a top view become semicircular shapes, for example. In addition, as illustrated in FIG. 14, in a case where the conductor post 19A and the external terminal 20A are positioned at the end portions of the coil component 10, the conductor post 19A and the external terminal 20A are connected to each other via a notch portion 33 formed in the cover insulative layer 30.

Figure 15:
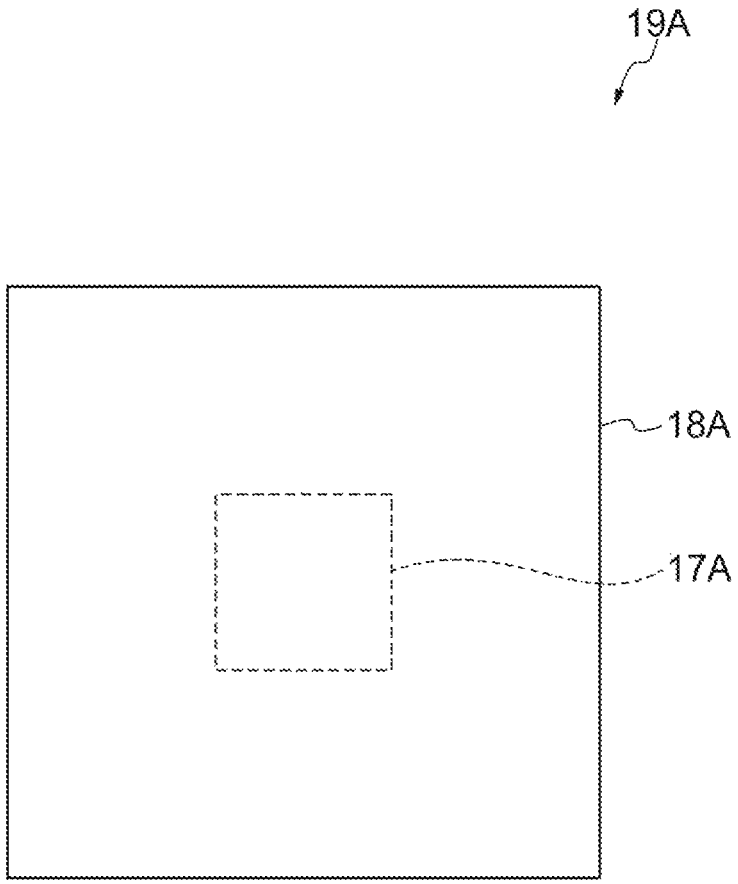
FIG. 15 is a top view illustrating another modification example of the conductor post in FIG. 7.

In addition, in the embodiment, a case where the shapes of the post portions 17A and 17B and the lid portions 18A and 18B are circular shapes in a top view has been described. However, the shapes of the post portions 17A and 17B and the lid portions 18A and 18B in a top view are not particularly limited. For example, as illustrated in FIG. 15, the shapes of the post portion 17A and the lid portion 18A in a top view may be rectangular shapes.

In addition, the shapes of the through-holes 31*a* and 32*a* of the cover insulative layer 30 are not particularly limited and can be changed to any shapes. For example, in the embodiment, a case where the through-holes 31*a* and 32*a* have circular shapes has been described. However, the through-holes 31*a* and 32*a* may have rectangular shapes. In addition, the dimensions D3 of the through-holes 31*a* and 32*a* may be smaller than the dimensions D2 of the post portions 17A and 17B and may be greater than the dimensions D1 of the lid portions 18A and 18B.

What is claimed is:

1. A coil component comprising:

a coil portion having at least one layer of planar coil including a coil-wound portion and an insulative layer covering the periphery of the coil-wound portion;

a covering portion covering the coil portion and constituted of a mixture including magnetic fillers and resin;

a conductor post provided in the covering portion so as to penetrate the covering portion and extending from the coil-wound portion to an outer surface of the covering portion along an axial direction of the planar coil;

a cover insulative layer stacked on the covering portion and having an opening at a position corresponding to the conductor post exposed from the covering portion; and an external terminal stacked on the cover insulative layer and connected electrically to the conductor post via the opening of the cover insulative layer, wherein the conductor post has a post portion and a lid portion, the post portion extends from the coil-wound portion in the axial direction of the planar coil, and the lid portion is exposed from the covering portion and extends from an end portion of the post portion on the outer surface side along a surface direction of the outer surface, and both a forming region of the external terminal and a forming region of the lid portion are entirely overlapping a forming region of the opening, and an area of the forming region of the external terminal and an area of the forming region of the lid portion are wider than an area of the forming region of the opening.

2. The coil component according to claim 1, wherein dimensions of the lid portion in the surface direction of the outer surface are ten times or greater than an average particle diameter of the magnetic filler.

3. The coil component according to claim 1, wherein dimensions of the lid portion in the surface direction of the outer surface are 1.1 times or greater than dimensions of the post portion.

4. The coil component according to claim 1, wherein a ratio of the magnetic filler included in the covering portion is 80 weight % or higher.

5. The coil component according to claim 1, wherein a cross-sectional area of the post portion in a cross section on a plane orthogonal to the axial direction of the planar coil is smaller than the area of the opening.

6. The coil component according to claim 1, wherein the entirely of the forming region of the lid portion is covered with the external terminal when seen in the axial direction of the planar coil.

7. The coil component according to claim 1, wherein a thickness of the lid portion is smaller than a thickness of the external terminal.

8. The coil component according to claim 1, wherein a part of the covering portion exists beneath the lid portion.

9. The coil component according to claim 8, wherein the part of the covering portion exists directly beneath the lid portion.

10. A method of manufacturing a coil component comprising:

a first step of forming a coil portion having at least one layer of planar coil including a coil-wound portion and an insulative layer covering the periphery of the coil-wound portion;

a second step of forming a covering portion covering the coil portion with a material including magnetic fillers and resin;

a third step of forming a conductor post extending from the coil-wound portion to an outer surface of the covering portion along an axial direction of the planar coil;

a fourth step of forming a cover insulative layer stacked on the covering portion and having an opening at a position corresponding to the conductor post exposed from the covering portion; and a fifth step of forming an external terminal stacked on the cover insulative layer and connected electrically to the conductor post via the opening of the cover insulative layer, wherein in the third step, the conductor post has a post portion and a lid portion is formed, the post portion extends from the coil-wound portion along the axial direction of the planar coil, and the lid portion is exposed from the covering portion and extends from an end portion of the post portion on the outer surface side along a surface direction of the outer surface, and both a forming region of the external terminal and a forming region of the lid portion are entirely overlapping a forming region of the opening, and an area of the forming region of the external terminal and an area of the forming region of the lid portion are wider than an area of the forming region of the opening.

11. The method of manufacturing a coil component according to claim 10, wherein in the third step, the lid portion is formed by polishing the outer surface of the covering portion.

* * * * *